US009435322B2

(12) United States Patent
Ramakumar et al.

(10) Patent No.: US 9,435,322 B2
(45) Date of Patent: Sep. 6, 2016

(54) VALVELESS RECIPROCATING COMPRESSOR

(75) Inventors: Karthik Ramakumar, Houston, TX (US); Omar M. Kabir, Waller, TX (US); Ken Ashraph, Houston, TX (US)

(73) Assignee: GE Oil & Gas Compression Systems, LLC, Houston, TX (US)

( * ) Notice: Subject to any disclaimer, the term of this patent is extended or adjusted under 35 U.S.C. 154(b) by 465 days.

(21) Appl. No.: 13/354,263

(22) Filed: Jan. 19, 2012

(65) Prior Publication Data

US 2013/0189139 A1 Jul. 25, 2013

(51) Int. Cl.
*F04B 7/04* (2006.01)
*F04B 53/12* (2006.01)

(52) U.S. Cl.
CPC ..... *F04B 7/04* (2013.01); *F04B 53/12* (2013.01); *F04B 53/121* (2013.01); *F04B 53/122* (2013.01)

(58) Field of Classification Search
CPC ..... F04B 7/04; F04B 27/005; F04B 27/02; F04B 27/0451; F04B 27/0456; F04B 27/053; F04B 53/12; F04B 53/121; F04B 53/122
USPC ..... 417/273, 490, 491, 493, 498, 510, 534
See application file for complete search history.

(56) References Cited

U.S. PATENT DOCUMENTS 2,296,647 A * 9/1942 McCormick ..... 91/306
2,415,618 A 2/1947 West
2,495,445 A * 1/1950 Crenshaw ..... 91/173
3,991,574 A * 11/1976 Frazier ..... 60/645
4,120,619 A 10/1978 Blackband
4,286,929 A * 9/1981 Heath et al. ..... 417/404
5,921,755 A * 7/1999 Eldridge ..... 417/255
7,713,037 B2 * 5/2010 Hosokawa et al. ..... 417/510
2006/0090477 A1 * 5/2006 Rolff ..... 62/6
2008/0294040 A1 11/2008 Mohiuddin et al.
2010/0209265 A1 * 8/2010 Dowling ..... F04B 53/18 417/404
2010/0303656 A1 * 12/2010 Lin et al. ..... 417/496

FOREIGN PATENT DOCUMENTS

DE 2006824 A1 * 8/1971 ..... F04B 7/04
GB 149890 A 8/1920

OTHER PUBLICATIONS

Machine Translation of foreign Publication No. DE2006824A1; dated Aug. 1971; Name: Stelzer, Frank.*
PCT International Search Report for Application No. PCT/US2012/061497 dated Feb. 6, 2013.

* cited by examiner

*Primary Examiner* — Patrick Hamo
(74) *Attorney, Agent, or Firm* — Fletcher Yoder P.C.

(57) ABSTRACT

A system, in certain embodiments, includes a compression cylinder configured to mount to a reciprocating compressor. The compression cylinder includes an intake port and a discharge port. The system also includes a piston assembly disposed within the compression cylinder. The piston assembly includes a piston configured to selectively block the intake port upon movement of the piston assembly relative to the compression cylinder.

33 Claims, 7 Drawing Sheets

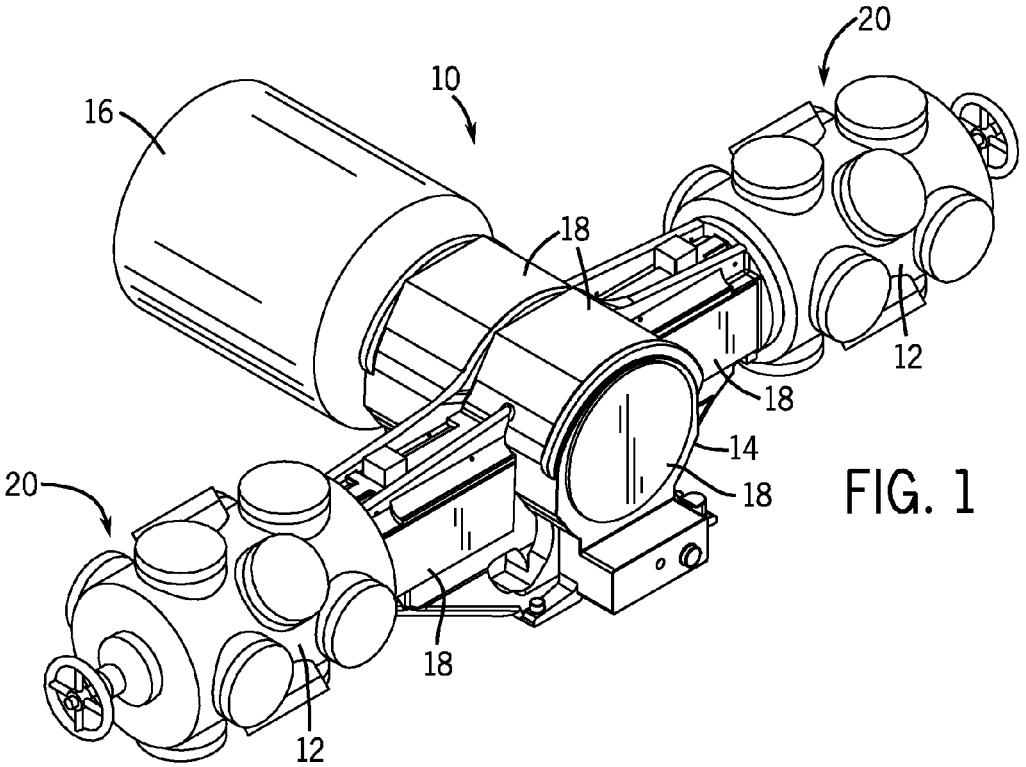
FIG. 1
FIG. 2
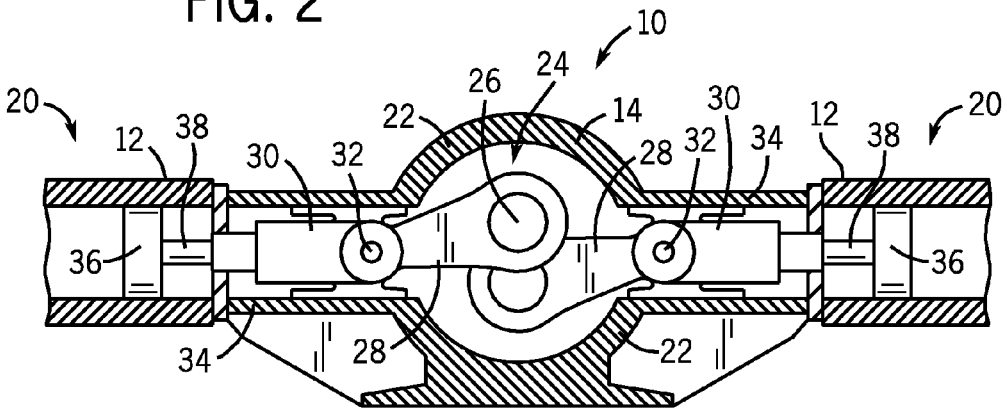

VALVELESS RECIPROCATING COMPRESSOR

FIELD OF THE INVENTION

The present invention relates generally to reciprocating machinery, such as reciprocating compressors. More particularly, the present invention relates to a valveless reciprocating compressor.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

A reciprocating compressor is a positive-displacement device, which utilizes a motor to drive one or more pistons via a crank shaft and connecting rods. Each piston reciprocates back and forth in a compression cylinder to intake a process fluid (e.g., natural gas, air, carbon dioxide, etc.) into a chamber, compress the process fluid within the chamber, and exhaust the process fluid from the chamber to a desired output. In certain reciprocating compressors, valves may be used to control the flow of the process fluid into and out of the chamber. However, valves possess inherent operational inefficiencies. In addition, valve maintenance significantly increases the costs associated with operating the compressor.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 1 is a perspective view of an exemplary reciprocating compressor in accordance with an embodiment of the present invention;

FIG. 2 is a cross-sectional view of the exemplary reciprocating compressor of FIG. 1, illustrating internal components of the reciprocating compressor;

DETAILED DESCRIPTION OF SPECIFIC EMBODIMENTS

Figure 3:
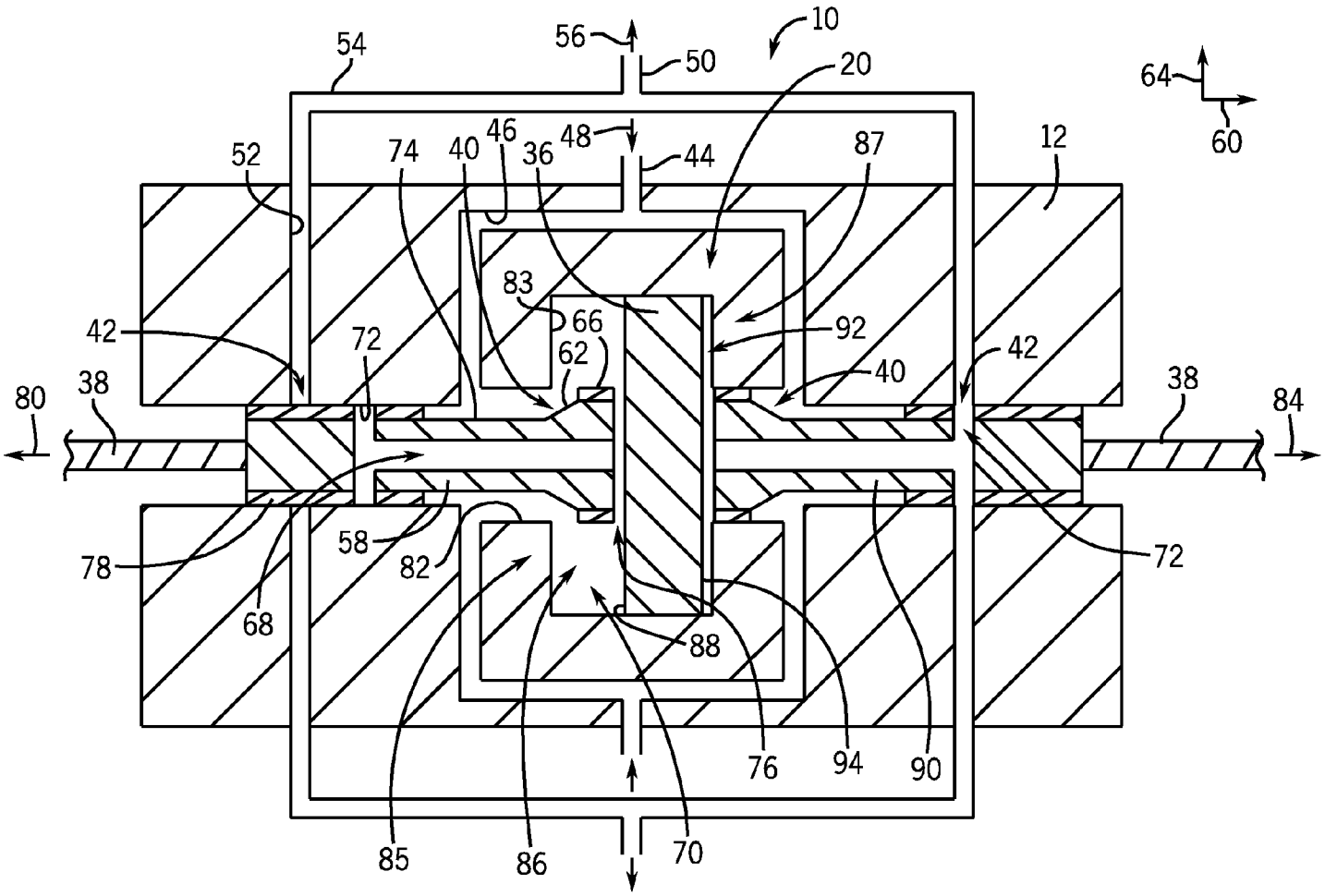
FIG. 3 is a cross-sectional view of an embodiment of a reciprocating compressor having a flow control member configured to selectively block an intake port and a discharge port.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure may substantially increase operational efficiency of a reciprocating compressor by providing a piston assembly configured to selectively block an intake port and a discharge port via movement of the piston assembly within a compression cylinder. For example, in certain embodiments, a reciprocating compressor includes a compression cylinder having an intake port and a discharge port. The compressor also includes a piston assembly disposed within the compression cylinder. The piston assembly is configured to successively block the intake port, to compress a fluid within an interior volume of the compression cylinder, and to discharge the fluid through the discharge port upon movement of the piston assembly in a first direction. In addition, the piston assembly is configured to successively block the discharge port, to decrease a pressure of the fluid within the interior volume, and to intake additional fluid into the interior volume through the intake port upon movement of the piston assembly in a second direction, opposite the first direction. Because the intake and discharge ports are selectively blocked by the piston assembly, valves (e.g., check valves), which may otherwise be used to control fluid flow through the ports, are obviated. As a result, operational costs associated with valve maintenance may be substantially reduced or eliminated. In addition, because the piston assembly does not interfere with flow through the ports, the efficiency of the reciprocating compressor may be significantly enhanced, as compared to configurations that employ valves which may partially block the ports while in the open position.

Turning now to the figures, an exemplary reciprocating compressor 10 is illustrated in FIG. 1. In the presently illustrated embodiment, the reciprocating compressor 10 includes a pair of compression cylinders 12 coupled to a frame 14. A variety of internal components may be disposed within the compression cylinders 12 and the frame 14 to enable compression of fluids introduced into the compression cylinders 12. For example, in certain embodiments, the reciprocating compressor 10 may be utilized to compress natural gas. However, in other embodiments, the reciprocating compressor 10 may be configured and/or utilized to compress other fluids, such as air, carbon dioxide, or nitrogen, among others.

A mechanical power source or driver 16, such as a combustion engine or an electric motor, may be coupled to the reciprocating compressor 10 to provide mechanical power to the various internal components to enable compression of the fluid within the compression cylinders 12. To facilitate access to such internal components, as may be desired for diagnostic or maintenance purposes, openings in the frame 14 may be provided and selectively accessed via removable covers 18. Further, the compression cylinders 12 may also include a piston assembly 20. As discussed in detail below, each compression cylinder 12 includes an intake port and a discharge port. The piston assembly 20 disposed within the compression cylinder 12 is configured to block the intake port upon movement of the piston assembly in a first direction. The piston assembly 20 is also configured to block the discharge port upon movement of the piston assembly 20 in a second direction, opposite the first direction. Because the intake and discharge ports are selectively blocked by the piston assembly 20, valves (e.g., check valves), which may otherwise be used to control fluid flow through the ports, are obviated. As a result, operational costs associated with valve maintenance may be substantially reduced or eliminated. In addition, because the piston assembly does not interfere with flow through the ports, the efficiency of the reciprocating compressor may be significantly enhanced, as compared to configurations that employ valves which may partially block the ports while in the open position.

FIG. 2 is a cross-sectional view of the exemplary reciprocating compressor 10 of FIG. 1, illustrating internal components of the reciprocating compressor 10. In the presently illustrated embodiment, the frame 14 of the exemplary reciprocating compressor 10 includes a hollow central body or housing 22 that generally defines an interior volume 24 within which various internal components may be housed, such as a crank shaft 26. In one embodiment, the central body 22 may have a generally curved or cylindrical shape. It should be noted, however, that the central body 22 may have other shapes or configurations in accordance with the disclosed embodiments.

In operation, the driver 16 rotates the crank shaft 26 supported within the interior volume 24 of the frame 14. In one embodiment, the crank shaft 26 is coupled to crossheads 30 via connecting rods 28 and pins 32. The crossheads 30 are disposed within crosshead guides 34, which generally extend from the central body 22 and facilitate connection of the compression cylinders 12 to the reciprocating compressor 10. In one embodiment, the reciprocating compressor 10 includes two crosshead guides 34 that extend generally perpendicularly from opposite sides of the central body or housing 22, although other configurations may be used. The rotational motion of the crank shaft 26 is translated via the connecting rods 28 to reciprocal linear motion of the crossheads 30 within the crosshead guides 34.

The compression cylinders 12 are configured to receive a fluid for compression. In the illustrated embodiment, the crossheads 30 are coupled to pistons 36 disposed within the compression cylinders 12 via piston rods 38. The reciprocating motion of the crossheads 30 enables compression of fluid within the compression cylinders 12 via the pistons 36. Particularly, as the piston assembly 20 is driven forwardly (i.e., outwardly from the central body 22) into a compression cylinder 12, a piston 36 of the piston assembly 20 forces the fluid within the cylinder into a smaller volume, thereby increasing the pressure of the fluid. Further forward movement of the piston assembly 20 unblocks a discharge port, thereby enabling compressed fluid to exit the compression cylinder 12. The piston assembly 20 may then stroke backward, thereby unblocking an intake port. Consequently, additional fluid may enter the compression cylinder 12 through the intake port for compression in the same manner described above. Because the intake and discharge ports are selectively blocked by the piston assembly, valves (e.g., check valves), which may otherwise be used to control fluid flow through the ports, are obviated.

FIG. 3 is a cross-sectional view of an embodiment of a reciprocating compressor 10 having a flow control member configured to selectively block an intake port and a discharge port. As illustrated, the compression cylinder 12 includes an intake port 40 and a discharge port 42. The intake port 40 is fluidly coupled to an inlet 44 via an internal passage 46 through the compression cylinder 12. In operation, the inlet 44 receives a flow of fluid 48, which is routed to the intake port 40 via the internal passage 46. While the intake port 40 is fluidly coupled to the inlet 44 via an internal passage 46 in the illustrated embodiment, it should be appreciated that alternative embodiments may utilize an external passage, or a combination of internal and external passages, to couple the inlet 44 to the intake port 40.

In the illustrated embodiment, the discharge port 42 is fluidly coupled to an outlet 50 via an internal passage 52 and an external passage 54. As discussed in detail below, the compressor 10 expels compressed fluid 56 through the discharge port 42. The fluid then flows through the internal passage 52 and the external passage 54 to the outlet 50. While the discharge port 42 is fluidly coupled to the outlet 50 via the internal passage 52 and the external passage 54, it should be appreciated that in alternative embodiments, the discharge port 42 and the outlet 50 may be directly coupled by an internal passage or an external passage, for example.

In the illustrated embodiment, the piston assembly 20 includes the piston 36, and a flow control member 58 extending from the piston 36 in an axial direction 60. The flow control member 58 may be integral with the piston 36, or coupled to the piston 36 (e.g., via fasteners, a welded connection, etc.). As discussed in detail below, the flow control member 58 is configured to block the intake port 40 during at least a portion of a compression stroke to facilitate fluid compression within the compression cylinder 12. The flow control member 58 is also configured to block the discharge port 42 duration at least a portion of an intake stroke to facilitate fluid flow into the compression cylinder 12. In this manner, the reciprocating compressor 10 may cyclically receive a flow of fluid from the inlet 44, compress the fluid within the compression cylinder 12, and expel the compressed fluid through the outlet 50. In the illustrated embodiment, the piston 36 compresses the fluid, and the flow control member 58 controls fluid flow into and out of the compression cylinder 12.

As illustrated, the flow control member 58 extends through the intake port 40, and includes a protrusion 62 that extends outwardly from the flow control member 58 in a radial direction 64. As discussed in detail below, the radial protrusion 62 is configured to selectively block the intake port 40, thereby establishing a substantially sealed volume that facilitates fluid compression. In the illustrated embodiment, the flow control member 58 includes a seal 66 disposed about the radial protrusion 62. The seal 66 is configured to substantially block fluid flow through the intake port 40 while the radial protrusion 62 is aligned with the intake port 40. As will be appreciated, the seal 66 may include a Babbitt seal, a labyrinth seal, a brush seal, and/or a ring seal, for example.

In addition, the flow control member 58 includes an internal passage 68 extending from an interior volume 70 of the compression cylinder 12 to an orifice 72 in an exterior surface 74 of the flow control member 58. As discussed in detail below, the flow control member 58 is configured to block the discharge port 42 while the orifice 72 is offset from the discharge port 42, and to facilitate flow through the discharge port 42 when the orifice 72 is aligned with the discharge port 42. To facilitate fluid flow from the internal volume 70 to the internal passage 68, the flow control member 58 includes multiple holes 76 extending in the radial direction 64 from the internal volume 70 to the internal passage 68. As will be appreciated, the number, size and/or shape of the holes 76 may be particularly selected to provide a desired fluid flow into the internal passage 68 while maintaining the structural integrity of the piston assembly 20.

In the illustrated embodiment, the flow control member 58 includes a seal 78 disposed about the exterior surface 74 of the flow control member 58 on opposite axial sides of the orifice 72. The seal 78 is configured to block fluid flow from the internal passage 68 until the orifice 72 is aligned with the discharge port 42. The seal 78 is also configured to facilitate fluid flow from the orifice 72 to the discharge port 42 while the orifice and discharge port are aligned. As will be appreciated, the seal 78 may include a Babbitt seal, a labyrinth seal, a brush seal, and/or a ring seal, for example. In the illustrated embodiment, the piston 36, the flow control member 58, the radial protrusion 62, and the seals 66 and 78 are annular structures. However, it should be appreciated that the piston 36, the flow control member 58, the radial protrusion 62, and the seals 66 and 78 may be other shapes (e.g., rectangular, polygonal, etc.) in alternative embodiments.

In operation, the piston assembly 20 is configured to compress fluid within the compression cylinder 12 via cyclical movement in the axial direction 60. For example, as the piston assembly 20 is driven to move in a first axial direction 80, the seal 66 contacts an inner surface 82 of the intake port 40, thereby blocking fluid flow into the interior volume 70. While the orifice 72 is not aligned with the discharge port 42, a substantially sealed volume is established, which includes the interior volume 70 and the internal passage 68. As the piston assembly 20 continues to translate in the direction 80, the size of the substantially sealed volume decreases as the piston 36 is driven toward an interior surface 83 of the internal volume 70. Accordingly, the pressure of the fluid within the substantially sealed volume progressively increases. Once the orifice 72 aligns with the discharge port 42, the pressurized fluid 56 flows through the discharge port 42 toward the outlet 50.

Once the piston assembly 20 has reached the end of the compression stroke, the piston assembly 20 is driven in the opposite axial direction 84 to facilitate additional fluid flow into the interior volume 70. For example, as the piston assembly 20 is driven to move in the second axial direction 84, the orifice 72 becomes offset from the discharge port 42. As a result, the seal 78 substantially blocks fluid flow through the discharge port 42. Furthermore, while the seal 66 is in contact with the inner surface 82 of the intake port 40, a substantially sealed volume is established, which includes the interior volume 70 and the internal passage 68. As the piston assembly 20 continues to translate in the direction 84, the size of the substantially sealed volume increases as the piston 36 is driven away from the interior surface 83 of the internal volume 70. Accordingly, the pressure of the fluid remaining within the substantially sealed volume progressively decreases. Once the seal 66 is offset from the inner surface 82 of the intake port 40, the reduced fluid pressure within the interior volume 70 draws additional fluid 48 from the inlet 44 through the intake port 40 and into the internal volume 70. Once the piston assembly 20 reaches the end of the intake stroke, the piston assembly 20 is driven in the first axial direction 80, and the process repeats.

In the illustrated embodiment, the reciprocating compressor 10 includes a double-acting piston assembly 20 configured to compress fluid within a first side 85 of the compression cylinder 12 while receiving fluid into a second side 87 of the compression cylinder 12. In this configuration, movement of the piston assembly 20 in the first axial direction 80 compresses fluid within the first side 85 of the compression cylinder 12, and receives fluid into the second side 87 of the compression cylinder 12. Conversely, movement of the piston assembly 20 in the second axial direction 84 compresses fluid within the second side 87 of the compression cylinder 12, and receives fluid into the first side 85 of the compression cylinder 12. As illustrated, the piston assembly 20 includes two flow control members configured to control fluid flow within respective volumes of the compression cylinder 12. The first flow control member 58 is configured to control fluid flow within a first volume 86 adjacent to a first side 88 of the piston 36. Similarly, a second flow control member 90 is configured to control fluid flow within a second volume 92 adjacent to a second side 94 of the piston 36.

In operation, as the piston assembly 20 moves in the direction 80, the first flow control member 58 successively blocks the intake port 40, drives the piston 36 to compress fluid within the first volume 86, and discharges the fluid through the discharge port 42. In addition, the second flow control member 90 successively blocks the discharge port 42, drives the piston 36 to decrease fluid pressure within the second volume 92, and receives additional fluid into the second volume 92 through the intake port 40. Conversely, as the piston assembly 20 moves in the direction 84, the first flow control member 58 successively blocks the discharge port 42, drives the piston 36 to decrease fluid pressure within the first volume 86, and receives additional fluid into the first volume 86 through the intake port 40. In addition, the second flow control member 90 successively blocks the intake port 40, drives the piston 36 to compress fluid within the second volume 92, and discharges the fluid through the discharge port 42. Because the reciprocating compressor 10 outputs compressed fluid with each stroke, the flow rate of compressed fluid may be greater than compressors employing single-acting piston assemblies having a single flow control member. While the illustrated embodiment employs a double-acting piston assembly 20 to provide an increased flow of compressed fluid, it should be appreciated that alternative embodiments may employ single-acting piston assemblies.

Because the intake port 40 and the discharge port 42 are selectively blocked by the piston assembly 20, valves (e.g., check valves), which may otherwise be used to control fluid flow through the ports, are obviated. As a result, operational costs associated with valve maintenance may be substantially reduced or eliminated. For example, to service a valved compressor (e.g., to replace valve springs, to replace valve stems, etc.), the compressor may be deactivated and disassembled. The worn components may then be replaced and/or repaired, and the compressor reassembled. In certain compressor configurations, such valve maintenance may be performed every three to six months, for example. As a result, valve maintenance may result in increased operational costs, and prolonged compressor unavailability. Because the illustrated embodiment obviates the valves, compressor maintenance costs may be significantly reduced, while enhancing compressor availability. Furthermore, because the piston assembly 20 does not interfere with flow through the ports 40 and 42, the efficiency of the reciprocating compressor may be significantly enhanced, as compared to configurations that employ valves which may partially block the ports while in the open position.

Figure 4:
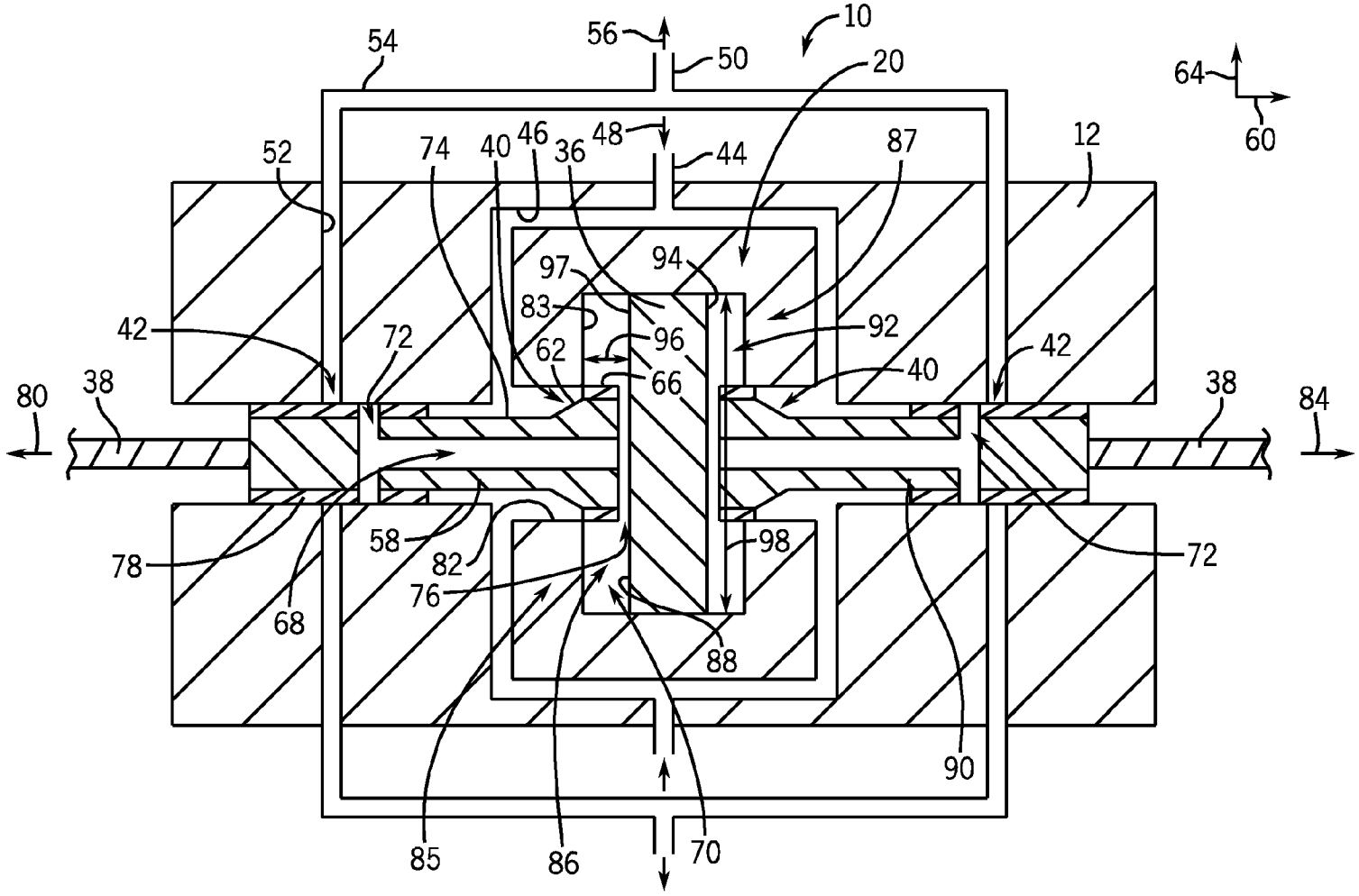
FIG. 4 is a cross-sectional view of the reciprocating compressor of FIG. 3, illustrating movement of a piston assembly relative to a compression cylinder.

FIG. 4 is a cross-sectional view of the reciprocating compressor 10 of FIG. 3, illustrating movement of the piston assembly 10 relative to the compression cylinder 12. As illustrated, the seal 66 of the first flow control member 58 is in contact with the inner surface 82 of the intake port 40, thereby establishing a substantially sealed volume, which includes the interior volume 70 and the internal passage 68. As the piston assembly 20 translates in the direction 80, the size of the substantially sealed volume decreases as the piston 36 is driven toward the interior surface 83 of the internal volume 70. In the illustrated embodiment, the stroke of the piston rod 38 drives the piston 36 to translate a distance 96, thereby decreasing the size of the substantially sealed volume by an amount equal to the cross-sectional area of the outer radial portion 97 of the piston 36 multiplied by the stroke distance 96. As the volume decreases, the pressure of the fluid within the substantially sealed volume progressively increases. Once the orifice 72 aligns with the discharge port 42, the pressurized fluid 56 flows through the discharge port 42 toward the outlet 50.

As will be appreciated, the change in size of the substantially sealed volume is at least partially dependent on the stroke distance 96, and a diameter 98 of the piston 36. For example, increasing the stroke distance 96 provides a greater change in the fluid volume, thereby increasing compression. Conversely, decreasing the stroke distance 96 provides a reduced change in the fluid volume, thereby decreasing compression. Furthermore, a piston 36 having a larger diameter 98 establishes a larger sealed volume, while a piston 36 having a smaller diameter 98 establishes a smaller sealed volume. The initial size of the sealed volume defines the fluid volume prior to compression. Consequently, a larger initial volume facilitates compression of more fluid per stroke than a smaller initial volume. As will be appreciated, the force sufficient to compress the fluid within the compression cylinder 12 is at least partially dependent upon the initial fluid volume and the degree of fluid compression. Therefore, the stroke distance 96 and the diameter 98 of the piston 36 may be particularly selected to provide the desired degree of compression, the desired flow rate through the reciprocating compressor 10, and the desired work applied by the power source 16.

Figure 5:
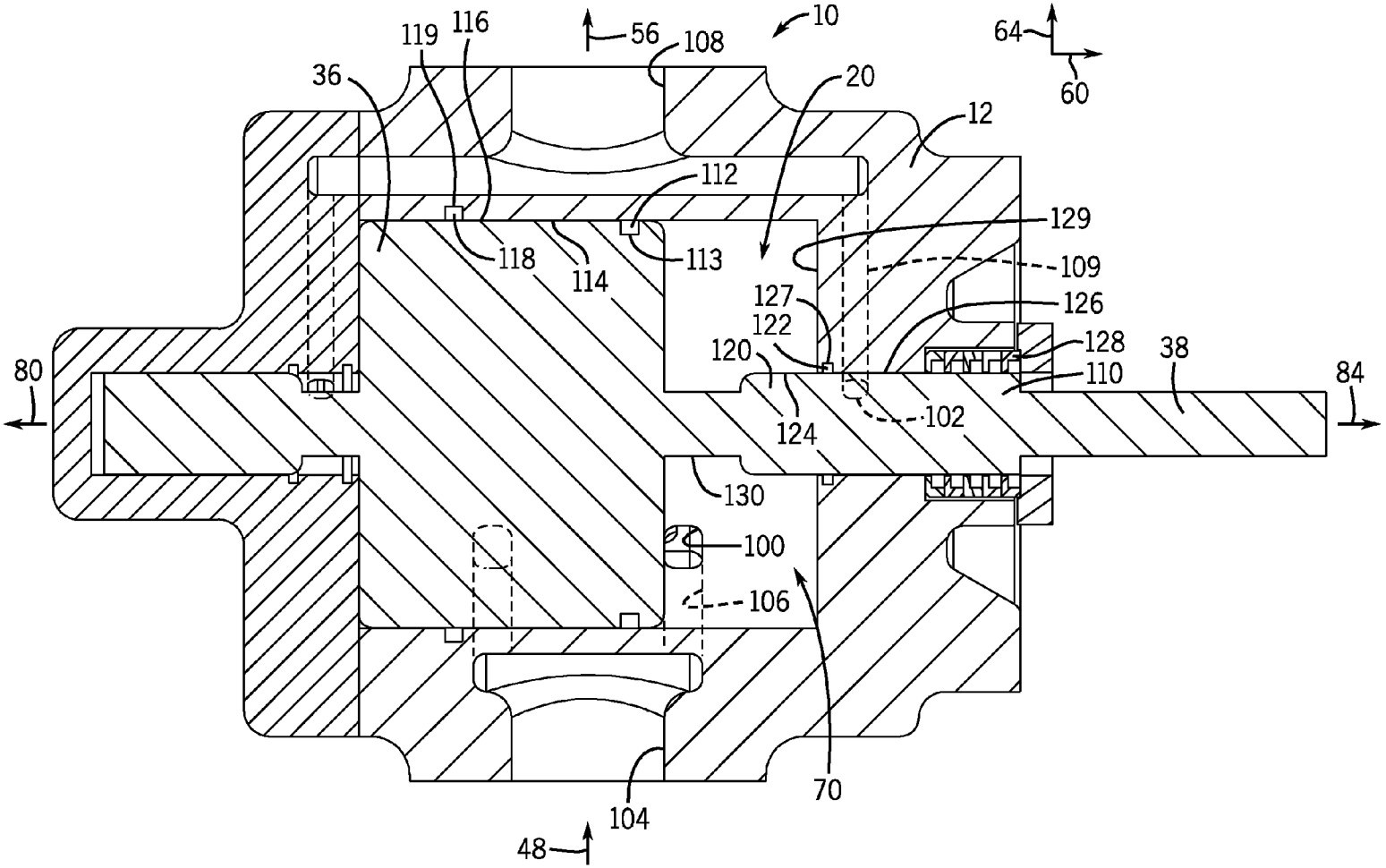
FIG. 5 is a cross-sectional view of another embodiment of a reciprocating compressor having a piston configured to selectively block an intake port, and a flow control member configured to selective block a discharge port.

FIG. 5 is a cross-sectional view of another embodiment of a reciprocating compressor 10 having a piston configured to selectively block an intake port, and a flow control member configured to selective block a discharge port. As illustrated, the compression cylinder 12 includes an intake port 100 and a discharge port 102. The intake port 100 is fluidly coupled to an inlet 104 via an internal passage 106 through the compression cylinder 12. In operation, the inlet 104 receives a flow of fluid 48, which is routed to the intake port 100 via the internal passage 106. While the intake port 100 is fluidly coupled to the inlet 104 via an internal passage 106 in the illustrated embodiment, it should be appreciated that alternative embodiments may utilize an external passage, or a combination of internal and external passages, to couple the inlet 104 to the intake port 100.

In the illustrated embodiment, the discharge port 102 is fluidly coupled to an outlet 108 via an internal passage 109. As discussed in detail below, the compressor 10 expels compressed fluid 56 through the discharge port 102. The fluid then flows through the internal passage 109 to the outlet 108. While the discharge port 102 is fluidly coupled to the outlet 108 via an internal passage 109 in the illustrated embodiment, it should be appreciated that alternative embodiments may utilize an external passage, or a combination of internal and external passages, to couple the outlet 108 to the discharge port 102. In the illustrated embodiment, the inlet 104 and the outlet 108 are directed outwardly from the compression cylinder 12 in the radial direction 64. Accordingly, substantially straight conduits may be coupled to the inlet 104 and to the outlet 108, thereby enhancing flow efficiency, as compared to configurations that employ bent conduits coupled to axial ends of the compression cylinder 12. In the illustrated embodiment, the outlet 108 is positioned on the top of the compression cylinder 12, and the inlet 104 is positioned on the bottom of the compression cylinder 12. However, it should be appreciated that the inlet 104 may be positioned on the top, and the outlet 108 may be positioned on the bottom. In such embodiments, the intake port 100 may be positioned above the discharge port 102 within the compression cylinder 12. Such a configuration may facilitate enhanced flow through the compression cylinder 12 in compressors 10 having an inlet pipe positioned above the cylinder 12, and a discharge pipe positioned below the cylinder 12.

In the illustrated embodiment, the piston assembly 20 includes the piston 36, and a flow control member 110 extending from the piston 36 in the axial direction 60. The flow control member 110 may be integral with the piston 36 and/or the piston rod 38, or coupled to the piston 36 and/or the piston rod 38 (e.g., via fasteners, a welded connection, etc.). As discussed in detail below, the flow control member 110 is configured to block the discharge port 102 during at least a portion of an intake stroke, and the piston 36 is configured to block the intake port 100 during at least a portion of a compression stroke. In this manner, the reciprocating compressor 10 may cyclically receive a flow of fluid from the inlet 104, compress the fluid within the compression cylinder 12, and expel the compressed fluid through the outlet 108.

In the illustrated embodiment, the piston 36 is configured to block the intake port 100 as the piston 36 is driven in the direction 84, thereby establishing a substantially sealed volume 70 that facilitates fluid compression. To provide the substantially sealed volume 70, the piston assembly 20 includes a first seal 112 disposed within a recess 113 in an exterior surface 114 of the piston 36. The first seal 112 is configured to substantially block fluid flow between the exterior surface 114 of the piston 36 and an interior surface 116 of the compression cylinder 12. In addition, the piston assembly 20 includes a second seal 118 disposed within a recess 119 in the interior surface 116 of the compression cylinder 12. Similar to the first seal 112, the second seal 118 is configured to substantially block fluid flow between the exterior surface 114 of the piston 36 and the interior surface 116 of the compression cylinder 12. As will be appreciated, the seals 112 and 118 may include a Babbitt seal, a labyrinth seal, a brush seal, and/or a ring seal, for example. While two seals 112 and 118 are employed in the illustrated embodiment to show different seal positions, it should be appreciated that alternative embodiments may include a single seal (e.g., the first seal 112, or the second seal 118) to substantially block fluid flow between the exterior surface 114 of the cylinder 36 and the interior surface 116 of the compression cylinder 12.

In the illustrated embodiment, the flow control member 110 includes a protrusion 120 extending radially outward from the flow control member 110. The radial protrusion 120 is configured to block the discharge port 102 while the radial protrusion 120 is aligned with the discharge port 102. To provide the substantially sealed volume 70, the piston assembly 20 includes a seal 122 configured to substantially block fluid flow between an exterior surface 124 of the radial protrusion 120 and an interior surface 126 of the compression cylinder 12. As will be appreciated, the seal 122 may include a Babbitt seal, a labyrinth seal, a brush seal, and/or a ring seal, for example. While the illustrated seal 122 is disposed within a recess 127 in the interior surface 126 of the compression cylinder 12, it should be appreciated that the seal 122 may be disposed within a recess in the exterior surface 124 of the radial protrusion 120 in alternative embodiments.

The illustrated reciprocating compressor 10 also includes a packing seal 128 disposed about the radial protrusion 120, and configured to substantially block fluid flow out of the compression cylinder 12. While two seals 122 and 128 are employed in the illustrated embodiment, it should be appreciated that alternative embodiments may include more or fewer seals to substantially block fluid flow between the exterior surface 124 of the radial protrusion 120 and the interior surface 126 of the compression cylinder 12. In the illustrated embodiment, the piston 36, the flow control member 110, the radial protrusion 120, and the seals 112, 118, 122 and 128 are annular structures. However, it should be appreciated that the piston 36, the flow control member 110, the radial protrusion 120, and the seals 112, 118, 122 and 128 may be other shapes (e.g., rectangular, polygonal, etc.) in alternative embodiments.

In operation, the piston assembly 20 is configured to compress fluid within the compression cylinder 12 via cyclical movement in the axial direction 60. For example, as the piston assembly 20 is driven to move in the direction 84, the piston 36 moves across the intake port 100, thereby blocking fluid flow into the interior volume 70. While the radial protrusion 120 is aligned with the discharge port 102, a substantially sealed volume 70 is established. As the piston assembly 20 continues to translate in the direction 84, the size of the substantially sealed volume 70 decreases as the piston 36 is driven toward an interior axial surface 129 of the compression cylinder 12. Accordingly, the pressure of the fluid within the substantially sealed volume 70 progressively increases. Once the radial protrusion 120 is offset from the discharge port 102, and a reduced radius portion 130 of the flow control member 110 is aligned with the discharge port 102, a flow path is established that facilities flow of compressed fluid through the discharge port 102 toward the outlet 108.

Once the piston assembly 20 has reached the end of the compression stroke, the piston assembly 20 is driven in the opposite axial direction 80 to facilitate additional fluid flow into the interior volume 70. For example, as the piston assembly 20 is driven to move in the axial direction 80, the radial protrusion 120 aligns with the discharge port 102. As a result, fluid flow through the discharge port 102 is substantially blocked. Furthermore, while the piston 36 blocks the intake port 100, a substantially sealed volume 70 is established. As the piston assembly 20 continues to translate in the direction 80, the size of the substantially sealed volume increases as the piston 36 is driven away from the interior axial surface 129 of the compression cylinder 12. Accordingly, the pressure of the fluid remaining within the substantially sealed volume 70 progressively decreases. Once the piston 36 is offset from the intake port 100, the reduced fluid pressure within the interior volume 70 draws additional fluid 48 from the inlet 104 through the intake port 100 and into the internal volume 70. Once the piston assembly 20 reaches the end of the intake stroke, the piston assembly 20 is driven in the opposite axial direction 84, and the process repeats.

Because the intake port 100 and the discharge port 102 are selectively blocked by the piston assembly 20, valves (e.g., check valves), which may otherwise be used to control fluid flow, are obviated. As a result, operational costs associated with valve maintenance may be substantially reduced or eliminated. In addition, because the piston assembly 20 does not interfere with flow through the ports 100 and 102, the efficiency of the reciprocating compressor 10 may be significantly enhanced, as compared to configurations that employ valves which may partially block the ports while in the open position. For example, certain reciprocating compressors include check valves to control fluid flow through the intake and discharge ports. In such configurations, each valve is biased toward a closed position by a spring. When a pressure differential exerts a force on the valve greater than the spring bias, a poppet is lifted off a seat, thereby facilitating fluid flow through the valve. However, the flow area through the open valve is limited by the valve lift height. In addition, the fluid flow is turned approximately 90 degree as the fluid approaching the valve is directly laterally outward via contact with the poppet. As a result of the limited flow area and the turned flow, the pressure of the compressed fluid may drop as the fluid flows through the valve, thereby decreasing compressor efficiency. In contrast, because the illustrated embodiment obviates the valves, fluid may flow through the ports 100 and 102 without restriction and without turning, thereby increasing the efficiency of the reciprocating compressor 10.

Figure 6:
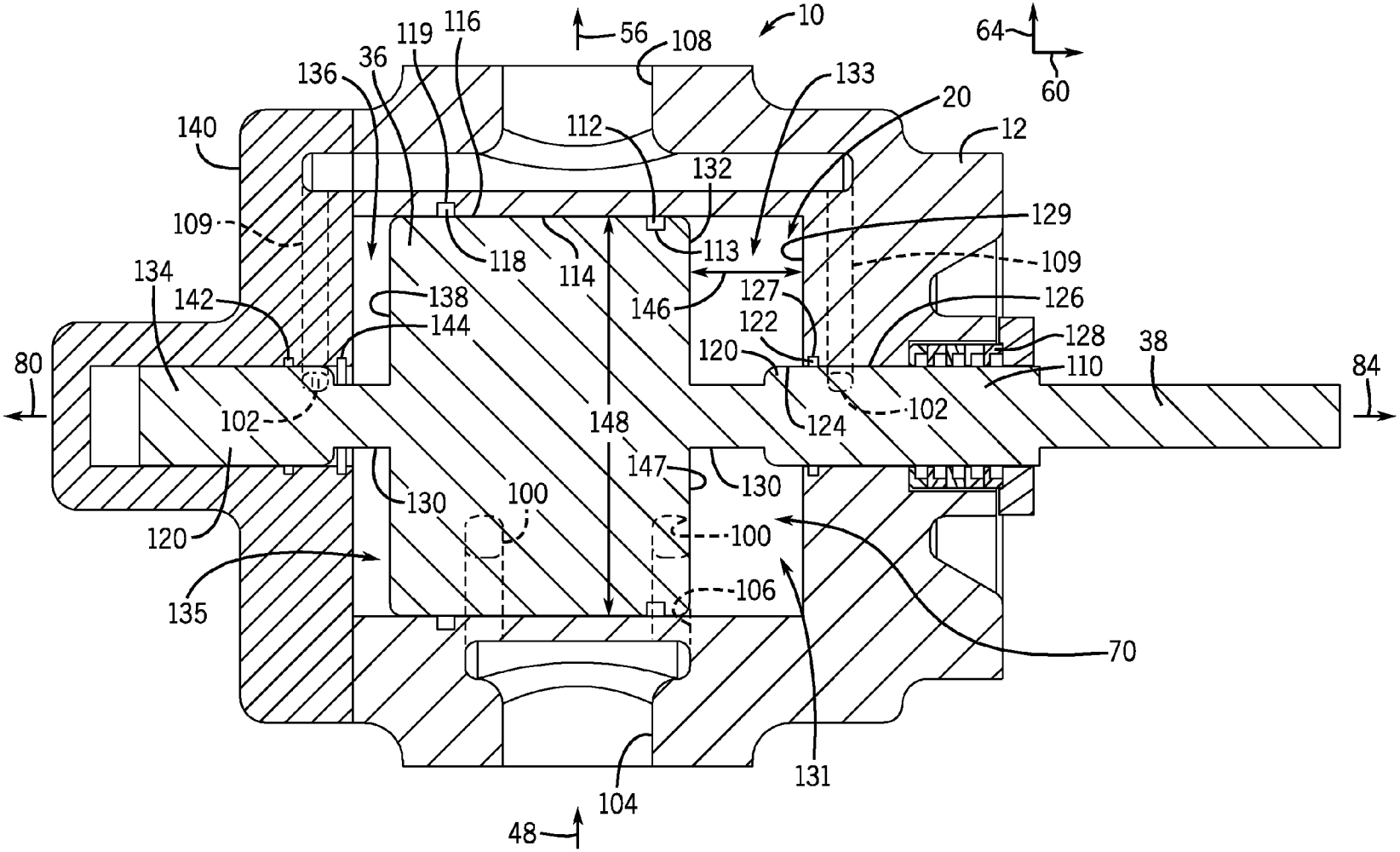
FIG. 6 is a cross-sectional view of the reciprocating compressor of FIG. 5, illustrating movement of a piston assembly relative to a compression cylinder.

FIG. 6 is a cross-sectional view of the reciprocating compressor of FIG. 5, illustrating movement of the piston assembly 20 relative to the compression cylinder 12. In the illustrated embodiment, the reciprocating compressor 10 includes a double-acting piston assembly 20 configured to compress fluid within a first side 133 of the compression cylinder 12, while receiving fluid into a second side 135 of the compression cylinder 12. In this configuration, movement of the piston assembly 20 in the axial direction 84 compresses fluid within the first side 133 of the compression cylinder 12, and receives fluid into the second side 135 of the compression cylinder 12. Conversely, movement of the piston assembly 20 in the opposite axial direction 80 compresses fluid within the second side 135 of the compression cylinder 12, and receives fluid into the first side 133 of the compression cylinder 12. As illustrated, the piston assembly 20 includes two flow control members configured to control fluid flow within respective volumes of the compression cylinder 12. The first flow control member 110 is configured to control fluid flow within a first volume 131 adjacent to a first side 132 of the piston 36. Similarly, a second flow control member 134 is configured to control fluid flow within a second volume 136 adjacent to a second side 138 of the piston 36.

In the illustrated embodiment, the second flow control member 134 is driven to move by the piston 36. Consequently, as the piston rod 38 induces the piston 36 to move in the axial direction 80, the second flow control member 134 is driven to move in the axial direction 80. Conversely, as the piston rod 38 induces the piston 36 to move in the axial direction 84, the second flow control member 134 is driven to move in the axial direction 84. As illustrated, the second flow control member 134 is disposed within a cap assembly 140, which is coupled to the compression cylinder 12 (e.g., via fasteners). The cap assembly 140 includes a second internal passage 109 extending from a second discharge port 102 to the outlet 108. The cap assembly 140 also includes a first seal 142 and a second seal 144 disposed on opposite axial sides of the second discharge port 102. Similar to the seals 122 and 128, the seals 142 and 144 are configured to block fluid flow through the discharge port 102 while the radial protrusion 120 of the second flow control member 134 is aligned with the discharge port 102. As will be appreciated, the seals 142 and 144 may include a Babbitt seal, a labyrinth seal, a brush seal, and/or a ring seal, for example.

In operation, as the piston assembly 20 moves in the direction 84, the piston 36 successively blocks the intake port 100, and compresses fluid within the first volume 131. The radial protrusion 120 of the first flow control member 110 then moves out of alignment with the discharge port 102, thereby facilitating fluid flow through the discharge port 102. In addition, the piston 36 successively drives the second flow control member 134 to block the second discharge port 102, decreases fluid pressure within the second volume 136, and facilitates fluid flow through the second intake port 100 into the second volume 136. Conversely, as the piston assembly 20 moves in the direction 80, the first flow control member 110 successively blocks the discharge port 102, drives the piston 36 to decrease fluid pressure within the first volume 131, and drives the piston 36 out of alignment with the intake port, thereby facilitating flow of additional fluid into the first volume 131. In addition, the piston 36 successively blocks the second intake port 100, compresses fluid within the second volume 136, and drives the radial protrusion 120 of the second flow control member 134 out of alignment with the discharge port 102, thereby facilitating fluid flow through the discharge port 102. Because the reciprocating compressor 10 outputs compressed fluid with each stroke, the flow rate of compressed fluid may be greater than compressors employing single-acting piston assemblies having a single flow control member. While the illustrated embodiment employs a double-acting piston assembly 20 to provide an increased flow of compressed fluid, it should be appreciated that alternative embodiments may employ single-acting piston assemblies.

As illustrated, the piston 36 is aligned with the intake port 100, thereby blocking flow through the intake port 100, and establishing a substantially sealed volume 131. As the piston assembly 20 translates in the direction 84, the size of the substantially sealed volume 131 decreases as the piston 36 is driven toward the interior axial surface 129 of the compression cylinder 12. In the illustrated embodiment, the stroke of the piston rod 38 drives the piston 36 to translate a distance 146, thereby decreasing the size of the substantially sealed volume 131 by an amount equal to the cross-sectional area of an outer radial portion 147 of the piston 36 multiplied by the stroke distance 146. As the volume decreases, the pressure of the fluid within the substantially sealed volume 131 progressively increases. Once the reduced radius portion 130 of the flow control member 110 aligns with the discharge port 102, the pressurized fluid 56 flows through the discharge port 102 toward the outlet 108.

As will be appreciated, the change in size of the substantially sealed volume 131 is at least partially dependent on the stroke distance 146, and a diameter 148 of the piston 36. For example, increasing the stroke distance 146 provides a greater change in the fluid volume, thereby increasing compression. Conversely, decreasing the stroke distance 146 provides a reduced change in the fluid volume, thereby decreasing compression. Furthermore, a piston 36 having a larger diameter 148 establishes a larger sealed volume 131, while a piston 36 having a smaller diameter 148 establishes a smaller sealed volume 131. The initial size of the sealed volume defines the fluid volume prior to compression. Consequently, a larger initial volume compresses more fluid per stroke than a smaller initial volume. As will be appreciated, the force sufficient to compress the fluid within the compression cylinder 12 is at least partially dependent upon the initial fluid volume and the degree of fluid compression. Therefore, the stroke distance 146 and the diameter 148 of the piston 36 may be particularly selected to provide the desired degree of compression, the desired flow rate through the reciprocating compressor 10, and the desired work applied by the power source 16.

Figure 7:
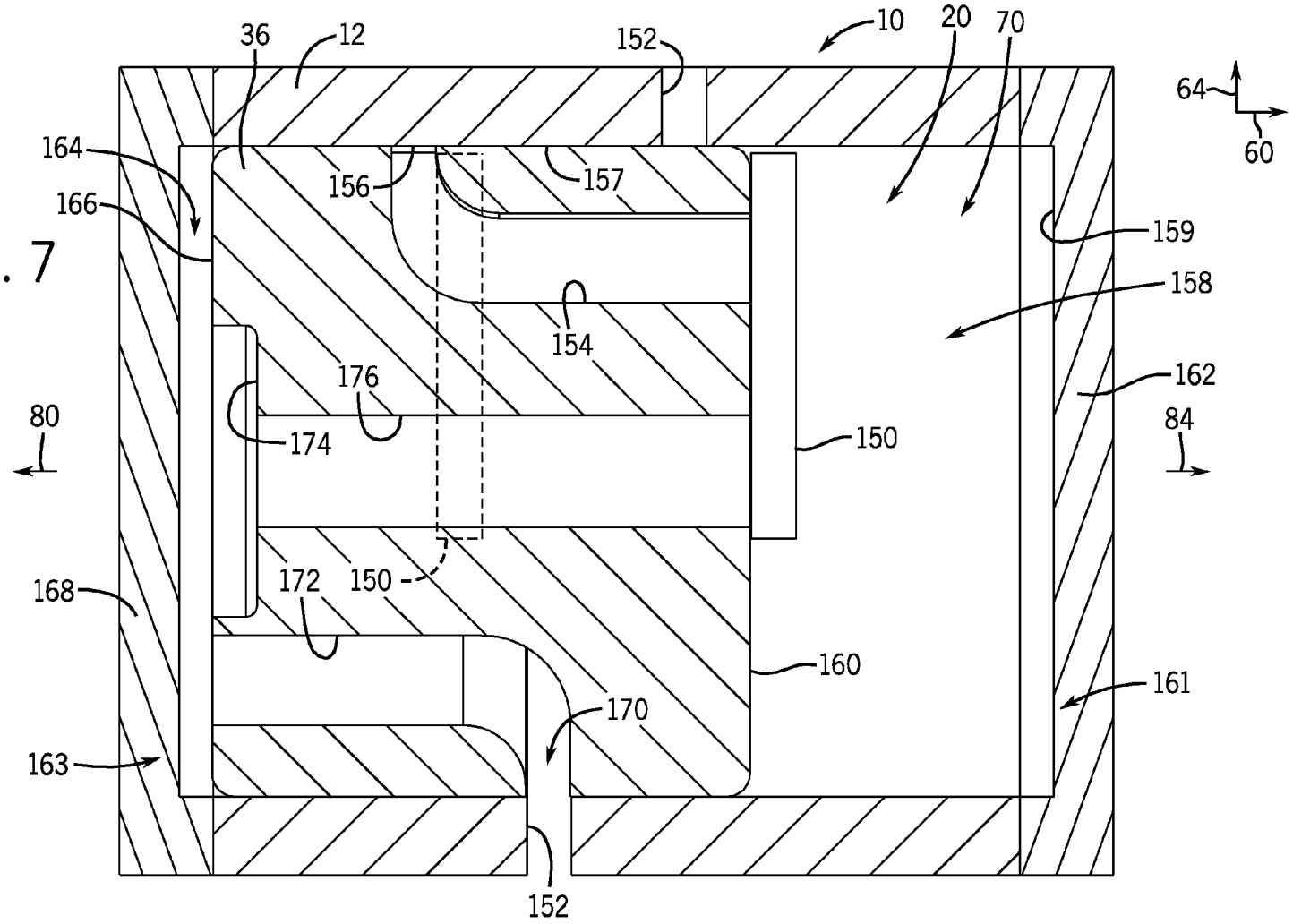
FIG. 7 is a cross-sectional view of a further embodiment of a reciprocating compressor having a piston configured to selectively block an intake port and a discharge port.

FIG. 7 is a cross-sectional view of a further embodiment of a reciprocating compressor having a piston configured to selectively block an intake port and a discharge port. As illustrated, the compression cylinder 12 includes an intake port 150 (e.g., first intake port on right and second intake port on left) and a discharge port 152 (e.g., first discharge port on top and second discharge port on bottom). As discussed in detail below, the piston 36 is configured to block the intake port 150 during at least a portion of a compression stroke, and to block the discharge port 152 during at least a portion of an intake stroke. In this manner, the reciprocating compressor 10 may cyclically receive a flow of fluid through the intake port 150, compress the fluid within the compression cylinder 12, and expel the compressed fluid through the discharge port 152.

In the illustrated embodiment, the piston 36 includes an internal passage 154 extending from the interior volume 70 of the compression cylinder 12 to an orifice 156 in an exterior surface 157 of the piston 36. As discussed in detail below, the piston 36 is configured to block the discharge port 152 while the orifice 156 is offset from the discharge port 152. Conversely, when the orifice 156 is aligned with the discharge port 152, the internal passage 154 establishes a flow path from the interior volume 70 to the discharge port 152, thereby facilitating flow of compressed fluid through the discharge port 152. In the illustrated embodiment, the piston 36 is an annular structure. However, it should be appreciated that the piston 36 may be other shapes (e.g., rectangular, polygonal, etc.) in alternative embodiments.

In operation, the piston assembly 20 is configured to compress fluid within the compression cylinder 12 via cyclical movement in the axial direction 60. For example, as the piston assembly 20 is driven to move in the axial direction 84, the piston 36 blocks the intake port 150, thereby blocking fluid flow into the interior volume 70. While the orifice 156 is not aligned with the discharge port 152, a substantially sealed volume 158 is established, which includes the interior volume 70 and the internal passage 154. As the piston assembly 20 continues to translate in the direction 84, the size of the substantially sealed volume 158 decreases as the piston 36 is driven toward an interior surface 159 of the internal volume 158. Accordingly, the pressure of the fluid within the substantially sealed volume 158 progressively increases. Once the orifice 156 aligns with the discharge port 152, the pressurized fluid is expelled through the discharge port 152.

Once the piston assembly 20 has reached the end of the compression stroke, the piston assembly 20 is driven in the opposite axial direction 80 to facilitate additional fluid flow into the interior volume 158. For example, as the piston assembly 20 is driven to move in the axial direction 80, the orifice 156 becomes offset from the discharge port 152. As a result, the piston 36 substantially blocks fluid flow through the discharge port 152. Furthermore, while the piston 36 blocks the intake port 150, a substantially sealed volume 158 is established, which includes the interior volume 70 and the internal passage 154. As the piston assembly 20 continues to translate in the direction 80, the size of the substantially sealed volume 158 increases as the piston 36 is driven away from the interior surface 159 of the internal volume 158. Accordingly, the pressure of the fluid remaining within the substantially sealed volume 158 progressively decreases. Once the piston 36 is offset from the intake port 150, the reduced fluid pressure within the interior volume 158 draws additional fluid through the intake port 150 and into the internal volume 158. Once the piston assembly 20 reaches the end of the intake stroke, the piston assembly 20 is driven in the opposite axial direction 84, and the process repeats.

In the illustrated embodiment, the reciprocating compressor 10 includes a double-acting piston assembly 20 configured to compress fluid within a first side 161 of the compression cylinder 12, while receiving fluid into a second side 163 of the compression cylinder 12. In this configuration, movement of the piston assembly 20 in the axial direction 84 compresses fluid within the first side 161 of the compression cylinder 12, and receives fluid into the second side 163 of the compression cylinder 12. Conversely, movement of the piston assembly 20 in the axial direction 80 compresses fluid within the second side 163 of the compression cylinder 12, and receives fluid into the first side 161 of the compression cylinder 12. As illustrated, the reciprocating compressor 10 includes a first volume 158 adjacent to a first side 160 of the piston 36. The first volume 158 is defined by the compression cylinder 12, the piston 36, and an end cap 162 coupled to the compression cylinder 12 (e.g., via fasteners). In addition, the reciprocating compressor 10 includes a second volume 164 adjacent to a second side 166 of the piston 36. The second volume 164 is defined by the compression cylinder 12, the piston 36, and an end cap 168 coupled to the compression cylinder 12 (e.g., via fasteners).

In operation, as the piston assembly 20 moves in the direction 84, the piston 36 successively blocks the first intake port 150 (e.g., right intake port in solid lines), and compresses fluid within the first volume 158. Once the orifice 156 is aligned with the first discharge port 152 (e.g., upper discharge port), compressed fluid flows through the internal passage 154, and is expelled through the first discharge port 152. In addition, the piston 36 successively blocks the second discharge port 152 (e.g., lower discharge port), decreases fluid pressure within the second volume 164, and unblocks the second intake port 150 (e.g., left intake port in dashed lines) to facilitate flow of additional fluid into the second volume 164. Conversely, as the piston assembly 20 moves in the direction 80, the piston 36 successively blocks the first discharge port 152 (e.g., upper discharge port), decreases fluid pressure within the first volume 158, and unblocks the first intake port 150 (e.g., right intake port in solid lines) to facilitate flow of additional fluid into the first volume 158. In addition, the piston 36 successively blocks the second intake port 150 (e.g., left intake port in dashed lines), and compresses fluid within the second volume 164. Once a second orifice 170 is aligned with the second discharge port 152 (e.g., lower discharge port), compressed fluid flows through a second internal passage 172, and is expelled through the second discharge port 152. Because the reciprocating compressor 10 outputs compressed fluid with each stroke, the flow rate of compressed fluid may be greater than compressors employing single-acting piston assemblies. While the illustrated embodiment employs a double-acting piston assembly 20 to provide an increased flow of compressed fluid, it should be appreciated that alternative embodiments may employ single-acting piston assemblies.

In the illustrated embodiment, the piston 36 includes a recess 174 and a passage 176 configured to receive a piston rod 38. In certain embodiments, the piston rod 38 extends through the end cap 162, thereby enabling the piston rod 38 to drive the piston 36 in the axial directions 80 and 84. As will be appreciated, a seal (e.g., a Babbitt seal, a labyrinth seal, a brush seal, a ring seal, etc.) may be disposed about the piston rod 38 to block fluid flow out of the compression cylinder 12. Furthermore, it should be appreciated that additional seals may be disposed throughout the reciprocating compressor 10. For example, seals may be positioned on opposite axial ends of the orifices 156 and 170 to block fluid flow through the discharge ports 152 until each orifice is aligned with a respective port. In addition, seals may be disposed about the intake ports 150 to block fluid flow through each intake port while the piston 36 is aligned with a respective intake port.

Because the intake port 150 and the discharge port 152 are selectively blocked by the piston 36, valves (e.g., check valves), which may otherwise be used to control fluid flow through the ports 150 and 152, are obviated. As a result, operational costs associated with valve maintenance may be substantially reduced or eliminated. In addition, because the piston assembly 20 does not interfere with flow through the ports 150 and 152, the efficiency of the reciprocating compressor 10 may be significantly enhanced, as compared to configurations that employ valves which may partially block the ports while in the open position. Furthermore, the internal passages 154 and 172 through the piston 36 may substantially reduce the reciprocating mass of the compressor 10, thereby reducing the energy utilized to drive the piston assembly 20 to move in the axial directions 80 and 84. As a result, efficiency of the reciprocating compressor 10 may be enhanced, as compared to configurations employing solid pistons.

Figure 8:
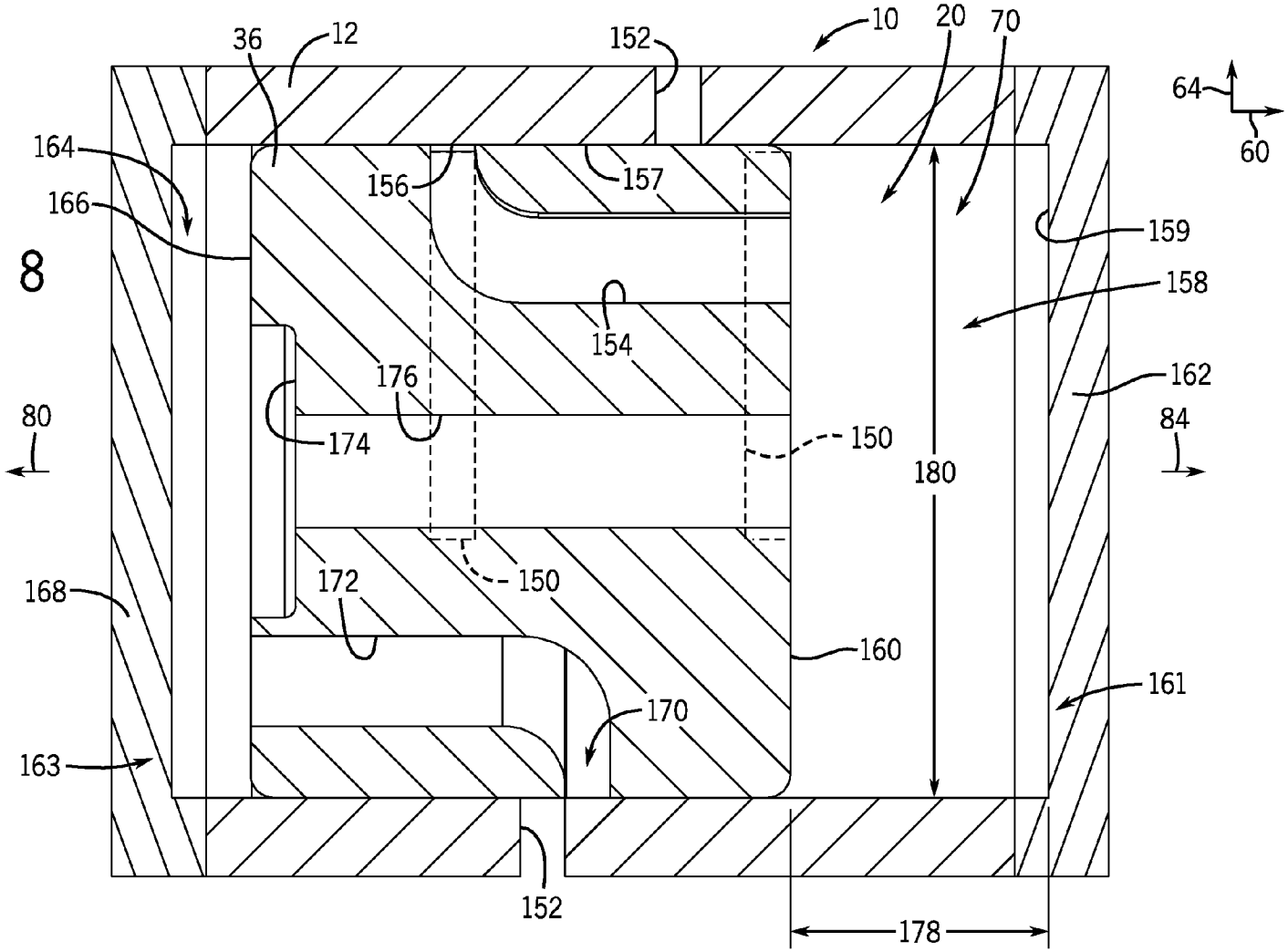
FIG. 8 is a cross-sectional view of the reciprocating compressor of FIG. 7, illustrating movement of the piston relative to a compression cylinder.

FIG. 8 is a cross-sectional view of the reciprocating compressor of FIG. 7, illustrating movement of the piston assembly 20 relative to the compression cylinder 12. As illustrated, the piston 36 is aligned with the intake port 150, thereby establishing a substantially sealed volume 158. As the piston assembly 20 translates in the direction 84, the size of the substantially sealed volume 158 decreases as the piston 36 is driven toward the interior surface 159 of the internal volume 158. In the illustrated embodiment, the stroke of the piston rod 38 drives the piston 36 to translate a distance 178, thereby decreasing the size of the substantially sealed volume 158 by an amount equal to the cross-sectional area of the piston 36 multiplied by the stroke distance 178. As the volume decreases, the pressure of the fluid within the substantially sealed volume 158 progressively increases. Once the orifice 156 aligns with the discharge port 152, the pressurized fluid is expelled through the discharge port 152.

As will be appreciated, the change in size of the substantially sealed volume 158 is at least partially dependent on the stroke distance 178, and a diameter 180 of the piston 36. For example, increasing the stroke distance 178 provides a greater change in the fluid volume, thereby increasing compression. Conversely, decreasing the stroke distance 178 provides a reduced change in the fluid volume, thereby decreasing compression. Furthermore, a piston 36 having a larger diameter 180 establishes a larger sealed volume, while a piston 36 having a smaller diameter 180 establishes a smaller sealed volume. The initial size of the sealed volume defines the fluid volume prior to compression. Consequently, a larger initial volume compresses more fluid per stroke than a smaller initial volume. As will be appreciated, the force sufficient to compress the fluid within the compression cylinder 12 is at least partially dependent upon the initial fluid volume and the degree of fluid compression. Therefore, the stroke distance 178 and the diameter 180 of the piston 36 may be particularly selected to provide the desired degree of compression, the desired flow rate through the reciprocating compressor 10, and the desired work applied by the power source 16.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a compression cylinder configured to mount to a reciprocating compressor, wherein the compression cylinder includes an intake port and a discharge port; and a piston assembly disposed within the compression cylinder, wherein the piston assembly comprises:

a piston configured to selectively block and unblock at least one of the intake port or the discharge port upon movement of the piston assembly relative to the compression cylinder; and a flow control member extending from the piston, wherein the flow control member and the piston are positionally fixed relative to one another, the flow control member is configured to selectively block and unblock at least one of the intake port or the discharge port upon movement of the piston assembly relative to the compression cylinder.

2. The system of claim 1, wherein the piston is configured to selectively block and unblock the intake port upon movement of the piston assembly relative to the compression cylinder, and the flow control member is configured to selectively block and unblock the discharge port upon movement of the piston assembly relative to the compression cylinder.

3. The system of claim 1, wherein the flow control member comprises a radial protrusion configured to selectively block the discharge port while the radial protrusion is aligned with the discharge port.

4. The system of claim 1, comprising a seal disposed between an exterior surface of the piston and an interior surface of an interior volume of the compression cylinder.

5. The system of claim 1, comprising a seal disposed between an exterior surface of the flow control member and an interior surface of an interior volume of the compression cylinder.

6. The system of claim 1, comprising an inlet fluidly coupled to the intake port via an internal passage through the compression cylinder.

7. The system of claim 1, comprising an outlet fluidly coupled to the discharge port via an internal passage through the compression cylinder.

8. The system of claim 1, wherein the flow control member is configured to control fluid flow within a first volume adjacent to a first side of the piston, the piston assembly comprises a second flow control member fixedly extending from the piston, and the second flow control member is configured to control fluid flow within a second volume adjacent to a second side of the piston.

9. The system of claim 1, wherein the piston excludes any internal passages to selectively align with the discharge port.

10. The system of claim 1, wherein a first external sidewall of the piston is configured to selectively cover and uncover at least one of the intake port or the discharge port upon movement of the piston assembly relative to the compression cylinder, a second external sidewall of the flow control member is configured to selectively cover and uncover at least one of the intake port or the discharge port upon movement of the piston assembly relative to the compression cylinder, and a radial width of the piston is greater than the flow control member.

11. The system of claim 1, wherein the flow control member extends axially away from a distal axial end of the piston.

12. The system of claim 1, wherein the flow control member extends along a central axis of the piston.

13. The system of claim 1, wherein the piston comprises a first passage extending through the piston to a first compression chamber on a first side of the piston, the piston comprises a second passage extending through the piston to a second compression chamber on a second side of the piston, and the first and second passages extend structurally and fluidly separate from one another through the piston.

14. A system, comprising:

a compression cylinder configured to mount to a reciprocating compressor, wherein the compression cylinder includes first and second intake ports and first and second discharge ports selectively in fluid communication with first and second compression chambers, respectively; and a piston assembly disposed within the compression cylinder between the first and second compression chambers, wherein the piston assembly comprises a piston;

wherein an external surface of the piston assembly is configured to selectively block and unblock the first intake port and the first discharge port associated with the first compression chamber and selectively block and unblock the second intake port and the second discharge port associated with the second compression chamber during a reciprocating motion of the piston assembly.

15. The system of claim 14, wherein the piston assembly comprises opposite first and second flow control members extending from opposite sides of the piston, the first and second flow control members and the piston are positionally fixed relative to one another, the first flow control member is configured to selectively block and unblock at least one of the first intake port or the first discharge port, and the second flow control member is configured to selectively block and unblock at least one of the second intake port or the second discharge port.

16. The system of claim 15, wherein the first flow control member is configured to selectively block and unblock the first intake port and the first discharge port, and the second flow control member is configured to selectively block and unblock the second intake port and the second discharge port.

17. The system of claim 15, wherein the piston is configured to selectively block and unblock at least one of the first intake port or the first discharge port, and the piston is configured to selectively block and unblock at least one of the second intake port or the second discharge port.

18. The system of claim 14, wherein the piston comprises a first passage extending through the piston associated with the first compression chamber, and the piston comprises a second passage extending through the piston associated with the second compression chamber.

19. The system of claim 18, wherein the first and second passages extend structurally and fluidly separate from one another through the piston, the first passage extends to a first side of the piston facing the first compression chamber, and the second passage extends to a second side of the piston facing the second compression chamber.

20. The system of claim 19, wherein the first passage selectively aligns with the first discharge port via the reciprocating motion of the piston assembly, and the second passage selectively aligns with the second discharge port via the reciprocating motion of the piston assembly.

21. The system of claim 14, wherein the external surface of the piston is configured to selectively cover and uncover the first intake port and the first discharge port associated with the first compression chamber and selectively cover and uncover the second intake port and the second discharge port associated with the second compression chamber during the reciprocating motion of the piston assembly.

22. The system of claim 14, comprising the reciprocating compressor having the compression cylinder and the piston assembly.

23. The system of claim 15, wherein the first flow control member extends axially away from a first distal axial end of the piston, and the second flow control member extends axially away from a second distal axial end of the piston.

24. The system of claim 15, wherein the first and second flow control members extend along a central axis of the piston.

25. A system, comprising:

a compression cylinder configured to mount to a reciprocating compressor, wherein the compression cylinder includes at least one intake port and at least one discharge port; and a piston assembly disposed within the compression cylinder, wherein the piston assembly comprises a piston having first and second passages extending separately, in fluid isolation from one another, through the piston, the first passage is associated with a first compression chamber on a first side of the piston, and the second passage is associated with a second compression chamber on a second side of the piston;

wherein the piston assembly is configured to selectively block and unblock the first passage associated with the first compression chamber and selectively block and unblock the second passage associated with the second compression chamber during a reciprocating motion of the piston assembly.

26. The system of claim 25, wherein the first passage extends to the first side of the piston facing the first compression chamber, and the second passage extends to the second side of the piston facing the second compression chamber.

27. The system of claim 26, wherein the first passage selectively aligns with a first discharge port of the at least one discharge port via the reciprocating motion of the piston assembly, and the second passage selectively aligns with a second discharge port of the at least one discharge port via the reciprocating motion of the piston assembly.

28. The system of claim 27, wherein an external surface of the piston is configured to selectively cover and uncover the first and second discharge ports during the reciprocating motion of the piston assembly.

29. The system of claim 27, wherein an external surface of the piston is configured to selectively cover and uncover first and second intake ports of the at least one intake port during the reciprocating motion of the piston assembly, the first intake port is associated with the first compression chamber, and the second intake port is associated with the second compression chamber.

30. The system of claim 25, wherein the piston assembly comprises a first rod extending from the first side of the piston, a second rod extending from the second side of the piston, or a combination thereof.

31. The system of claim 25, comprising a rod mounting passage extending at least partially through the piston along an axis of the piston.

32. The system of claim 25, comprising the reciprocating compressor having the compression cylinder and the piston assembly.

33. The system of claim 25, wherein an external surface of the piston assembly is configured to selectively block and unblock the first passage associated with the first compression chamber and selectively block and unblock the second passage associated with the second compression chamber during the reciprocating motion of the piston assembly.

* * * * *